United States Patent [19]
Morimoto et al.
[11] 4,297,093
[45] Oct. 27, 1981

[54] COMBUSTION METHOD FOR REDUCING NOX AND SMOKE EMISSION

[75] Inventors: Kotaro Morimoto; Tomio Suzuki, both of Kobe, Japan

[73] Assignee: Kobe Steel, Ltd., Kobe, Japan

[21] Appl. No.: 71,487

[22] Filed: Aug. 31, 1979

[30] Foreign Application Priority Data

Sep. 6, 1978 [JP] Japan ..... 53-110003

[51] Int. Cl.[3] ..... F23M 3/00
[52] U.S. Cl. ..... 431/10; 431/8; 431/9; 431/182
[58] Field of Search ..... 431/182, 184, 185, 186, 431/187, 188, 8–10; 239/402.5, 403, 404, 405, 406

[56] References Cited

U.S. PATENT DOCUMENTS

| | | | |
|---|---|---|---|
| 3,904,349 | 9/1975 | Peterson et al. | 431/184 |
| 4,050,879 | 9/1977 | Takahashi et al. | 431/175 |
| 4,106,890 | 8/1978 | Fulmer et al. | 431/184 |

*Primary Examiner*—James C. Yeung
*Attorney, Agent, or Firm*—Oblon, Fisher, Spivak, McClelland & Maier

[57] ABSTRACT

A combustion method which can reduce the emission of NOx and smoke. In sharp contrast to the conventional combustion method, the method of the invention can remarkably reduce the emission of both of NOx and the smoke simultaneously, by adopting a specific flow pattern of fuel and combustion air in the combustion chamber, the pattern has been obtained as a result of studies and experiments concerning the influence of the intensity of mixing of the fuel and the combustion air on the emission of NOx.

8 Claims, 19 Drawing Figures

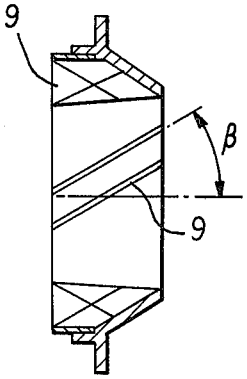
FIG. 2(III)

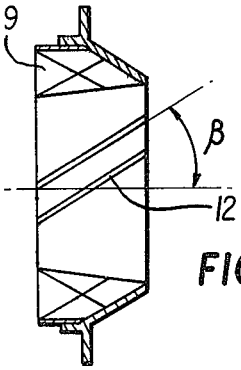
FIG. 4(III)

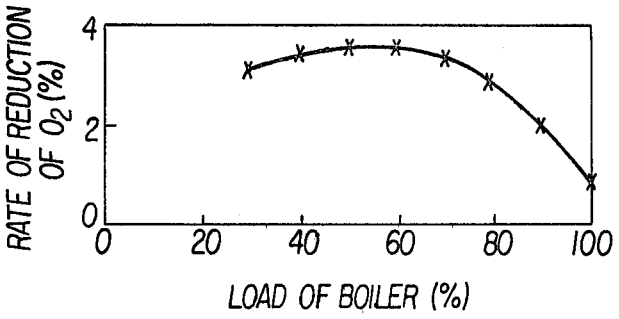
FIG. 10(I)
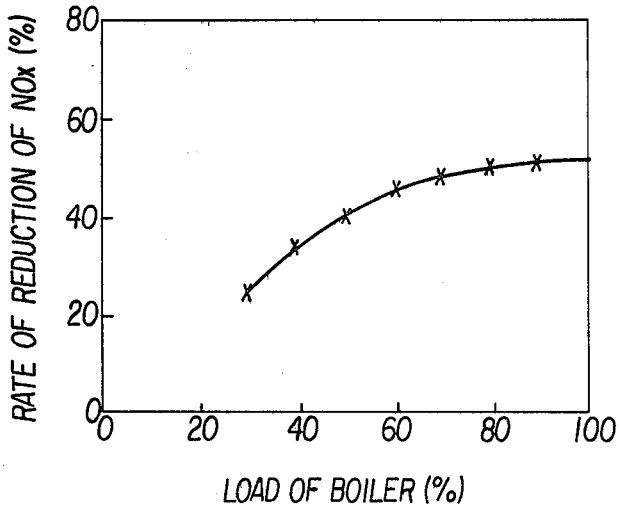
FIG. 10 (II)

COMBUSTION METHOD FOR REDUCING NOX AND SMOKE EMISSION

BACKGROUND OF THE INVENTION

The present invention relates to a combustion method for reducing nitrogen oxides and smoke emission.

The nitrogen oxides (referred to as NOx, hereinafter) produced in the combustion process in various industrial furnaces such as boilers are sorted broadly into "thermal NOx" and "fuel NOx" from the view point of the causes of the generation of NOx. For suppressing the generation of the thermal NOx, various effective methods have been known such as reduction of the flame temperature, reduction of oxygen concentration in the combustion zone and shortening of the stay time of the combustion gas in the combustion zone of high temperature. On the other hand, it is well known that the reduction of oxygen concentration in the combustion zone and the use of fuel having low nitrogen content are effective measures for suppressing the generation of fuel NOx.

From this point of view, there have been proposed and used various combustion techniques for supressing the generation of NOx, e.g. two-staged combustion, flue gas recirculation, increase of the cooling area of the furnace, use of low NOx burner, low-oxygen combustion and off stoichiometric combustion.

However, these conventional techniques are not applicable to all boilers. Namely, it is necessary to select these techniques suitably in accordance with the scale or size of the boiler, construction of the boiler, condition of operation and the like factors. The adoption of these conventional techniques also poses various problems concerning stability of the flame, emission of unburnt substances and smoke, responsive characteristic to the fluctuation of load and thermal efficiency. Further, the application of these conventional techniques to the existing boilers encounters various problems or difficulties such as cost of modification of the boiler, increase of the fuel consumption and so forth.

In the conventional various industrial furnaces, particularly in boilers, it is a current measure to reduce the size of the boiler by adopting a high heat liberation combustion. To this end, it is intended to rapidly mix the fuel injected from the burner with the combustion air to complete the combustion in a shorter period of time.

FIG. 1 is a side elevational sectional view of a construction of a burner and its vicinity in a conventional water-tube type package boiler. Referring to this Figure, the combustion air A supplied from a blower is regulated by a damper 1 and is made to swirl by register vanes 3 in a wind box 2. The swirling flow of the combustion air is then introduced into a combustion chamber 4. On the other hand, the fuel which may be either a gas, liquid or even solid is supplied to a burner 5 and is atomized from a burner tip 7 disposed in the burner-tile 6 into the combustion chamber. The fuel is then rapidly mixed with the combustion air, and the combustion is completed in a short period of time while the flame is held by a flame holder 8 such as a swirler provided at the end of the burner 5.

The illustrated combustion system is merely an example, and various other combustion systems have been used. For instance, there have been proposed and used combustion systems having double register vanes, or a combustion system with no register vane to eliminate the swirling of air. However, when it is desired to all of the combustion air, the register vanes are necessarily disposed in the wind box.

In the above-described combustion system, the swirl is given to the combustion air A at a region spaced in the upstream side by a considerable distance from the combustion zone in which the fuel and the air are mixed to make the combustion. Therefore, the swirl has been attenuated as the flow of air reaches the combustion zone. More specifically, the maximum axial component of the velocity of the swirling flow is in inverse proportion to the square of the axial distance from the point at which the swirl is started, and the maximum values of the tangential and radial components are changed also in inverse proportion to the square of the axial distance. Therefore, the swirl is considerably attenuated by the time when it reaches the combustion zone, and is changed into the state of a turbulent flow.

As a result, the combustion is unstabilized particularly when the load on the boiler is low.

It is also pointed out that a so-called edge current is likely to be produced behind the flame holder 8 attached to the end of the burner. Therefore, the disturbance of the air flow is further enhanced. As the fuel is injected to the flow of combustion air in a large scale of turbulence, the fuel is atomized as it penetrates the major flow of air. In consequence, the fuel and air are rapidly mixed uniformly, resulting in a high combustion rate and short flame length. As a result, the generation of NOx is inconveniently increased, although the high heat liberation combustion is achieved.

The rapid mixing of the fuel and air and the increase of generation of NOx attributable to the rapid mixing are notable particularly in case of a flue smoke tube boiler incorporating a diffuser as the flame holder. FIG. 2 is a side elevational sectional view showing the construction around the burner of such a type of boiler. Referring to FIG. 2, the combustion air A supplied from the blower is introduced into the wind box 2, and is divided into a primary air which flows through the diffuser provided at the end of the burner 5 and a secondary air which flows through a swirler 9 and then through the annular space between the diffuser 8 and the inner circle of the swirler 9 along the burnertile 6. The diffuser 8 has radial swirl slits and air ports of about 5 mm dia. formed in its conical wall. These swirl slits and the air ports in combination form a low speed zone of the air to stabilize the flame.

The swirler 9 of the air register has a conical outer surface which is selected from a view point of promotion of rapid combustion. Also, the swirler 9 has a ratio d/D of inside diameter d to the outside diameter D of 0.7 or greater. More specifically, the inside diameter d is the diameter of the inner circle of the swirler 9 in the plane including the conical bottom surface of the diffuser 8, while the outside diameter D is the diameter of the outer circle of the swirler 9 in the same plane, as shown in FIG. 2 I. In addition, the inlet angle $\alpha$ formed between the vane of the swirler 9 and the ring 4 to which the swirler 9 is attached is 15° or greater. (See FIG. 2 II).

Further, the swirling angle $\beta$ is selected to fall within the range of between 0° and 60°. This swirling angle $\beta$ is the angle formed between the vane of the swirler 9 and the axis of the burner as shown in FIG. 2 III. The swirling angle $\beta$ of 0° provides a straight air flow.

The air flowing through the aforementioned annular section is an axial flow, while the air passed through the swirler 9 constitutes an external swirling flow having an axial, tangential and a radial component. This external swirling flow collides with the above-mentioned axial flow in the burnertile 6 to form a jetting flow having a large scale of turbelency and a large velocity gradient. On the other hand, the fuel is injected from the burner tip 7 into the combustion chamber 4. A smaller part of fuel having small penetration is gently mixed with the primary air to be burnt in a state of rich mixture to stabilize the flame, while the major part of the fuel having a large penetration flows across the primary combustion zone so as to be mixed with the air flow of large scale of disturbance and large velocity gradient, thereby to form a secondary combustion zone. In this secondary combustion zone, the fuel is subjected to a turbulency and diffusion caused by the turbulency of the air flow and the shearing force of the air, and is mixed with the air uniformly to complete the combustion in a short period of time. In consequence, the combustion rate is rendered high, while the flame length is shortened, resulting in a high flame temperature to promote the generation of NOx.

SUMMARY OF THE INVENTION

Under this circumstance, the present invention aims at developing a novel combustion method effective in reducing the NOx and smoke emission even in medium or small-sized boilers to which the aforementioned conventional measures for reducing the NOx and smoke emission can hardly be applied, thereby to overcome above-stated problems of the prior art.

With the above-described knowledge of the mechanism of production of the NOx in conventional furnaces or combustion system, particularly of the medium and small-sized boilers, the present inventors have found that, for reducing the emission of NOx, it is effective to suppress the drastic progress of the combustion reaction, particularly to suppress as much as possible the rapid combustion in the region of large scale turbulence and velocity gradient of the secondary combustion zone to effect a gentle and uniform combustion. It has been found also that, in order to reduce the emission of the smoke, as well as NOx, it is effective to realize a combustion in such a state that the flame is enveloped by the swirling air.

From this point of view, the present inventors have made an intense study concerning the flow of fuel and the swirling flow of air having three dimensional components. As a result, the present inventors have succeeded in creating a new flow pattern which is effective in supressing the generation of NOx, as well as the smoke, to complete the invention.

According to one aspect of the invention, there is provided a combustion method for effecting combustion in a boiler, in which the combustion is made by giving a swirling to the combustion air by means of a swirler which is located at a position within 200 mm from the position of injection of the fuel, while adjusting the swirler such that the swirl number of the combustion air falls within the range of between 0.35 and 1.5, preferably 0.4 and 1.0, and that the mean flow axial velocity of the combustion air under the stoichiometric firing condition falls within the range of between 10 and 30 m/sec, preferably 13 and 23 m/sec at the outlet of the swirler.

According to another aspect of the invention, the combustion is effected with the inlet angle $\alpha$ of the diffuser of not greater than 15°.

According to still another aspect of the invention, the combustion air is divided into a primary air which flows through the diffuser and a secondary air which flows around the diffuser. At least the secondary air, which amounts to 65% or more of the whole combustion air, is made to swirl. At the same time, the position of injection of the fuel is adjusted.

Other aspects and advantages of the invention will become more clear from the following description of the preferred embodiment taken in conjunction with the accompanying drawings.

BRIEF DESCRIPTION OF THE DRAWINGS

FIG. 3 II is a schematic illustration of the swirler incorporated in the combustion system as shown in FIG. 3 I;

FIG. 4 II is a sectional view taken along the line A—A of FIG. 4 I;

FIG. 4 III is a schematic illustration of an essential part of the swirler;

FIGS. 10 I and 10 II are graphs showing the amount of reduction of $O_2$ and rate of reduction of NOx as observed in various boilers;

DETAILED DESCRIPTION OF THE PREFERRED EMBODIMENTS

Basically, the present invention is intended to control the combustion by giving a moderate swirling of a small scale of turbulence to the combustion air. This can be achieved by giving a swirl to the combustion air by means of a swirler disposed in the vicinity of the fuel injection port. Alternatively, as will be described later with reference to FIG. 4, a guide ring 10 is disposed to surround the diffuser so as to eliminate the axial flow of the air through the annular space around the diffuser, the axial flow constituting the major cause of increase of the scale of turbulency, so that the secondary air may be constituted solely by the external swirling flow.

According to the invention, the velocity and strength of swirl of the combustion air flow are moderated and optimized by adjusting the area of passage for air in the swirler and the angle of vanes of the swirler, thereby to obtain a desired flow pattern in the combustion chamber.

Figure 3I:
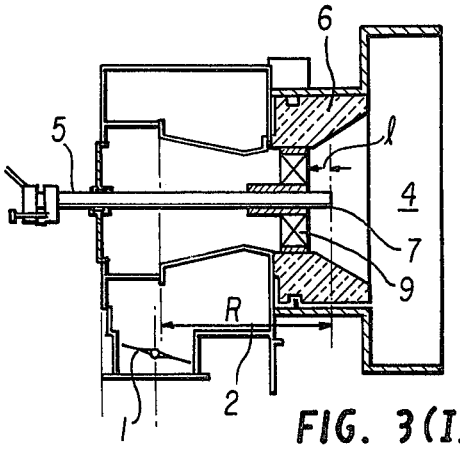
FIG. 3 I is a sectional view of an essential part of the combustion system including a burner for carrying out the combustion method of the invention.
Figure 3:
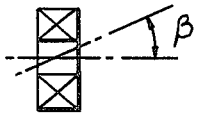

FIG. 3 I shows a side elevational sectional view of a combustion system having a burner suitable for use in carrying out the combustion method of the invention, while FIG. 3 II is a schematic illustration of a swirler of the combustion system shown in FIG. 3 I. The combustion system shown in these Figures are different from the conventional combustion system in that the register vanes in the wind box are eliminated and the swirl is given by a swirler 9 disposed around the burner tip 7 from which the fuel is injected. As will be explained later, the swirler is located preferably within 200 mm from the position of fuel injection (tip end).

Figure 4I:
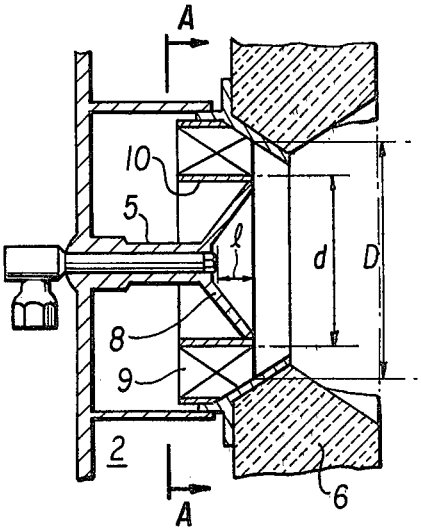
FIG. 4 I is a sectional view of an essential part of another combustion system for carrying out the combustion method of the invention.
Figure 4:
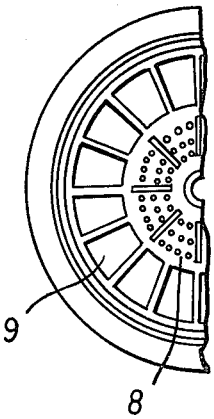

FIG. 4 shows another example of the combustion system suitable for use in carrying out the method of the invention. More specifically, FIG. 4 I is a side elevational sectional view, FIG. II is a sectional view taken along the line A—A and FIG. 4 III is a schematic illustration of the swirler.

Figure 2I:
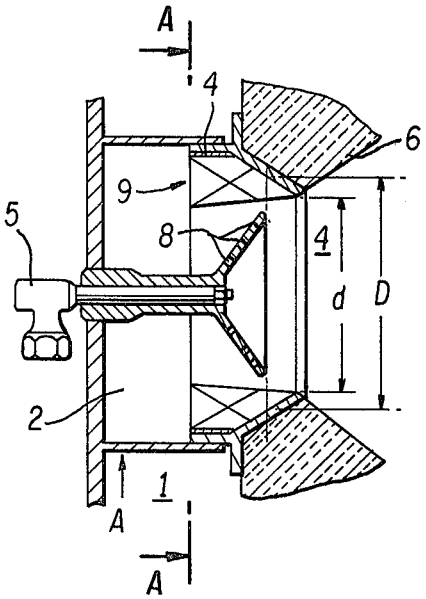
Figure 2:
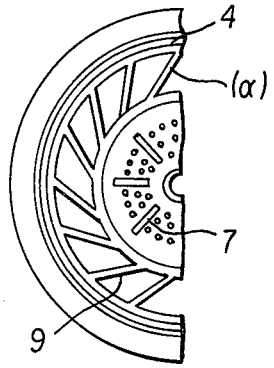

This combustion system is characterized in that a cylindrical guide ring 10 is disposed around the diffuser 8 to eliminate the axial flow of air, which flows through the annular space between the diffuser 8 and the circle contacting the inner side of the swirler 9 and which constitutes the major cause of increase of scale of the turbulency, so as to make the secondary air as shown in FIG. 2 solely by the external swirl of air.

In each case of the combustion systems of FIGS. 3 and 4, the flow velocity of the combustion air and the strength of the swirl are adjusted and optimized by adjustment of the area of passage for combustion air through the swirler 9, angle of vanes of the swirler and the like factors. As a result, a desired flow pattern is established in the combustion chamber.

According to the invention, an oil pressure injection burner generally having a spray angle of 30° to 80° or a two-fluid injection valve is preferably used. In case of a furnace having a low heat liberation rate such as industrial furnace, a straight injection type burner can be used, as well as a burner with a deflecting tip having an inclination angle of 5° to 45° to the air stream axis.

Figure 5:
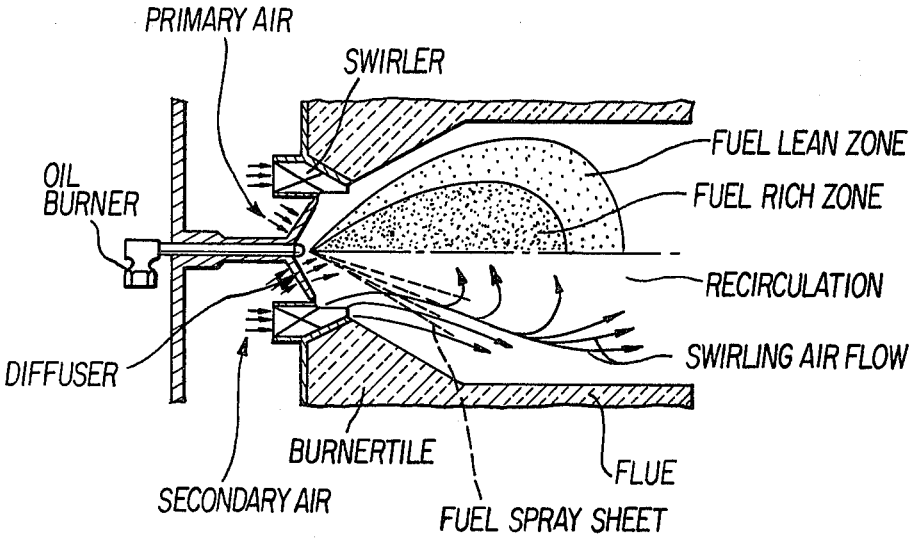
FIG. 5 is an illustration of the state of combustion.

FIG. 5 illustrates the process of combustion in accordance with the combustion method of the invention. A swirler which provides a suitable swirl strength and flow velocity is attached to the near portion of the burner tip so as to obtain a desired flow pattern. The fuel is injected to the inside of the spirally spreading flow of external swirling air. As a result, a part of the fuel is mixed with the primary air of low velocity and with a part of the external swirling air in a heterogeneous state and makes a combustion in the state of an excessively fuel rich mixture. Then, the remainder part of the fuel which has not been burnt in the region of the excessively rich mixture is uniformly mixed with the external swirling flow of high velocity in a homogeneous state to complete the combustion in the state of a fuel lean mixture.

The combustion method of the invention, therefore, resembles multi-staged combustion (two-staged combustion) which is known per se. In addition, thanks to the self flue gas recirculation effect caused by the inside circulating vortex which is peculiar to the external swirling flow, the maximum flame temperature, as well as the local oxygen partial pressure is decreased to make a sufficient suppression of the thermal NOx and fuel NOx. In addition, the flame is enveloped by the external swirling air to complete the combustion without contacting the furnace wall or water tube. As a result, the generation of soot and CO is effectively supressed and, in some cases, the low-oxygen combustion becomes possible to improve the boiler efficiency. This feature constitute one of the advantages brought about by the combustion method of the invention.

Figure 6:
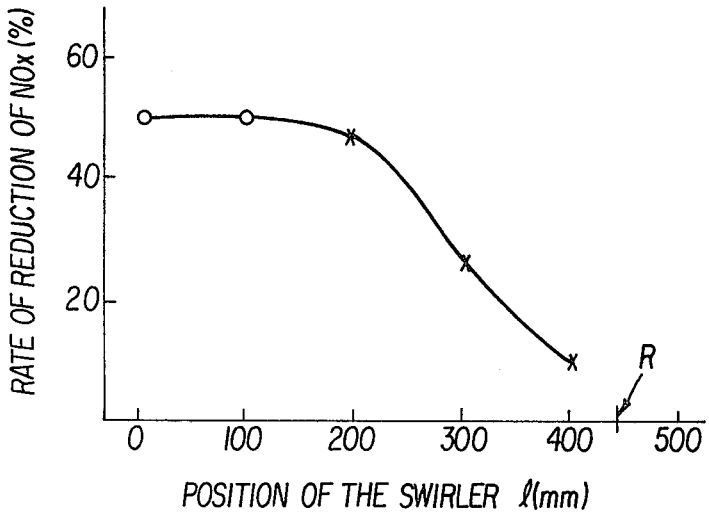
FIG. 6 is a graph showing how the effect of reduction of NOx is affected by the position of the swirler.

FIG. 6 is a graph showing the relationship between the dustance l of the burner tip end 7 from the inner end of the swirler as shown in FIG. 3 and the rate of reduction of NOx. This relationship was observed through an experiment which was carried out by changing the relative distance l by changing the position of the swirler while keeping the burner tip end stationary. Also, the rate of reduction of NOx (%) is given as the rate of reduction of NOx generation in relation to the NOx generation observed when a radial flow type register vanes are used. In FIG. 6, the mark X shows a case in which the deposition of carbon was caused to hinder the practical use. From FIG. 6, it will be apparent that a larger reduction of NOx generation is obtained as the distance between the burner tip and the swirler is reduced, and the effect of reduction of NOx generation is decreased as the relative distance between the burner tip and the swirler is increased. At the same time, the increase of the relative distance enhances the tendency of deposition of carbon to the burner tip, which in unfavourable from the view point of operation of the boiler. Therefore, it is preferred to locate the swirler at a position as close as possible to the burner tip. This can be understood also from the mechanism of reduction of NOx generation upon which the combustion method of the invention relies. The maximum relative distance varies depending on the construction of the combustion system. However, generally, it is preferred to locate the swirler at a position upstream from the burner tip end and within 200 mm from the latter. In case of the burner having a diffuser as shown in FIG. 4, the arrangement may be such that the inner axial end of the swirler is positioned at the downstream side of the burner tip end. In such a case, the distance between the burner tip end and the inner axial end of the swirler is preferably not greater than about 200 mm.

Figure 7I:
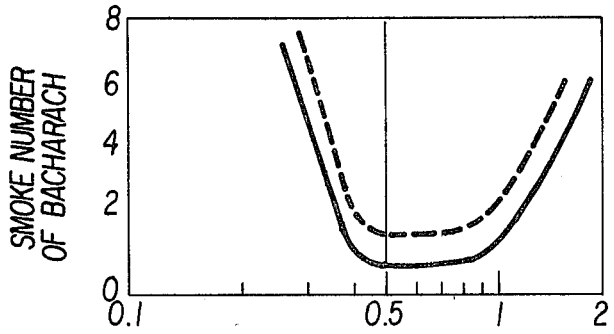
FIGS. 7 I and 7 II are graphs showing, respactively, how the smoke number and the rate of reduction of NOx are affected by the swirl number.
Figure 7:
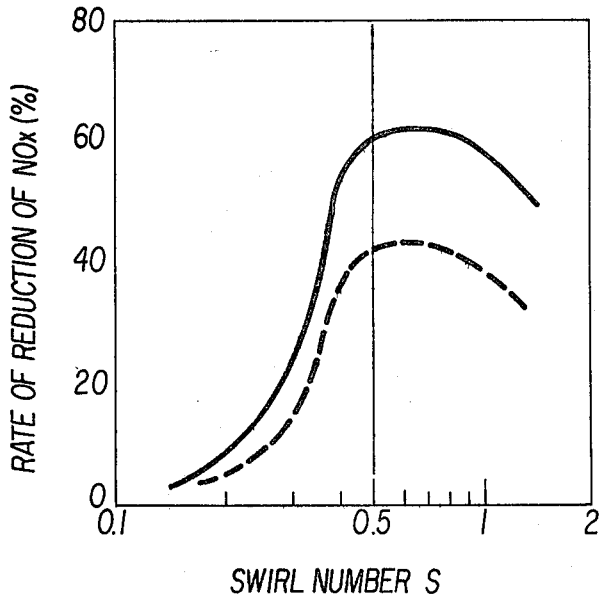

FIG. 7 is a graph showing how the strength of swirl of the air affects the rate of reduction of NOx and generation of smoke. More specifically, FIG. 7 I shows a smoke number of Bacharach in relation to the swirl number, while FIG. 7 II shows the rate of reduction of NOx generation. In these Figures, the full-line curves and the broken-line curves show the characteristics obtained when a kerosene and a heavy oil is used as the fuel. The mean flow velocity of the combustion air in this case was selected to fall within the range of between 12 m/S and 30 m/s, while the relative position of the swirler and the burner tip end was suitably set to provide sufficiently small generation of NOx and smoke. The swirl number S as represented by the following equation is used as the index of the strength of the swirl of air. Also, the mean flow velocity was determined by dividing the whole amount of air the outlet area of the swirler.

$$\text{Swirl Number } S = \tfrac{2}{3}\tan\beta\left[\frac{1-(d/D)^3}{1-(d/D)^2}\right]$$

In the above equation, D and d represent, respectively, the outside diameter and inside diameter of the swirler, while $\beta$ represents the swirling angle of inclination of the swirler. (See FIGS. 3 II, 4 II and 4 III.)

As will be seen from FIG. 7 I, the generation of smoke is increased as the swirl number S becomes small and also as the swirl number becomes large. Also, no remarkable effect of reduction of NOx generation is found when the swirl number S is small and large. This is attributable to the fact that the combustion air flow released through the burnertile cannot form a sufficiently grown-up external swirling flow of air when the swirl number is small. In such a case, a flow pattern which is almost an axial flow is formed in the combustion chamber, so that the conically sprayed fuel collides with the combustion air to rapidly form a uniform mixture resulting in a reduced effect of reduction of NOx generation. Also, since the penetration force of the fuel is strong, the fuel collides with the water tubes (or furnace wall) before they are burnt, resulting in a generation of the smoke.

To the contrary, when the swirl number is large, the external swirl is spread excessively so that the major flow of the swirl air flows in the close proximity of the water tubes or the furnace wall. As a result, the supply of the combustion air to the central area of the combustion chamber is rendered insufficient to excessively widen the fuel rich zone, so that various unfavourable combustion states occur such as increased production of the smoke or so-called pulsation combustion, although the reduction of NOx production is not spoiled.

Therefore, judging synthetically taking all aspects such as effect of reduction of NOx and smoke emission and pulsation combustion, the swirl number is preferably about 0.35 to 1.5, more preferably 0.4 to 1.0 further preferably 0.4 to 0.6. It is possible to maintain a good combustion with the swirl number as specified above. In case of an existing or already-constructed boiler, the pressure drop across the swirler is increased to cause a problem of shortage of power of the blower, if the boiler is modified to increase the number of swirl. Therefore, in such a case, a comparatively small swirl number, e.g., 0.4 to 0.6 is preferably selected from the above specified range.

The flow velocity of the combustion air is also an important factor which affects the flow pattern in the combustion chamber. In order to obtain a sufficient effect of reduction of NOx emission, as well as the smoke emission, the air flow velocity is selected to fall within the range of between about 10 m/s and about 30 m/s, more preferably between 13 m/s and 23 m/s, under stoichiometric firing condition (air excess ratio of 1.0) with rated load.

The influence of the air flow velocity, however, differs depending on the kind of the fuel used. Therefore, when a gas or light oil is used, the flow velocity is selected preferably to fall within the range of between about 10 m/s and about 25 m/sec, while for a comparatively heavy fuel such as heavy oil, the flow velocity is selected to fall within the range of between about 15 m/s and 30 m/s. The angle $\beta$ of the swirler is suitably selected to fall within the range of between, for example, about 15° and about 60°, more preferably 20°–45°.

Figure 8:
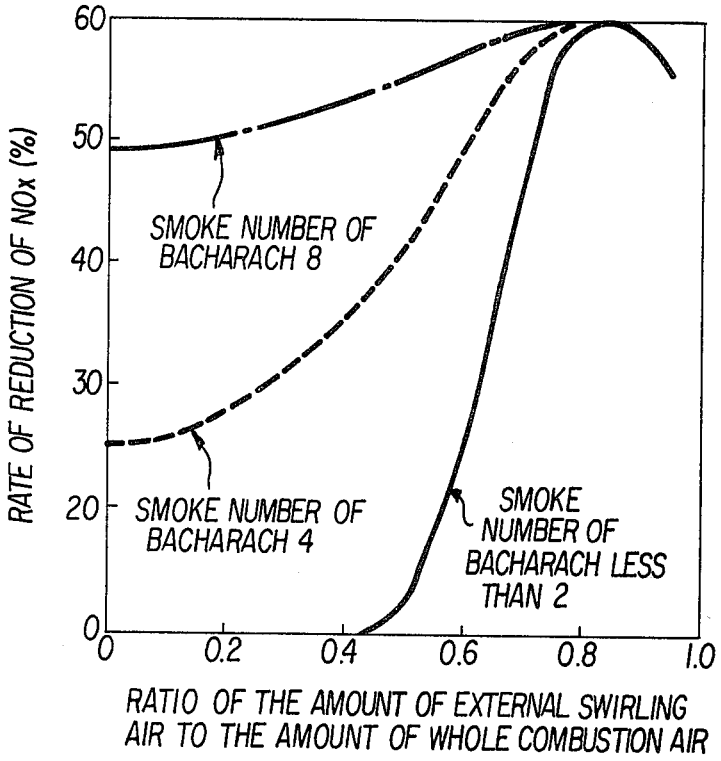
FIG. 8 is a graph showing the relationship between the ratio of the external swirl air flow (secondary air) to the whole combustion air and the rate of reduction of NOx.

FIG. 8 shows the relationship between the ratio of the amount of external swirling air to the amount of whole combustion air and the rate of reduction of NOx generation, as observed when the mean flow velocity of the combustion air around the burner is 10 m/s to 30 m/s. More specifically, the position of fuel injection or spray was set at a position which provides the maximum reduction of NOx generation with a Bacharach smoke number of 2 or smaller for each ratio of external swirling air to the whole combustion air. Then, the oxygen concentration is lowered to a point at which the emission of smoke is commenced. The rates of reduction of NOx generation at such points are plotted in FIG. 8. A too high or a too low flow velocity of air makes it difficult to form the flow pattern desired for the reduction of generation of NOx and smoke. Thus, the mean flow velocity of air around the burner is preferably between 10 m/s and 30 m/s. Referring to FIG. 8, if the aforementioned ratio of external swirling air to the whole combustion air is too small, the combustion of fuel mixed with the primary air passing through the diffuser becomes dominative, so that it becomes impossible to suppress the generation of NOx solely by the position of spray of the fuel. If the oxygen concentration is lowered to reduce the generation of NOx, the generation of smoke is increased undesirably. This means that there is a practical limit in the reduction of NOx generation.

To the contrary, as the external swirling air (secondary air) is increased, the rate of reduction of NOx generation is increased under a condition of Bacharach smoke number of not greater than 2 in which the generation of smoke is not so serious. The reduction of NOx generation is appreciable if 65% or more of the whole combustion air is distributed to the external swirl and becomes remarkable as the above-stated ratio exceeds 70%.

Figure 9:
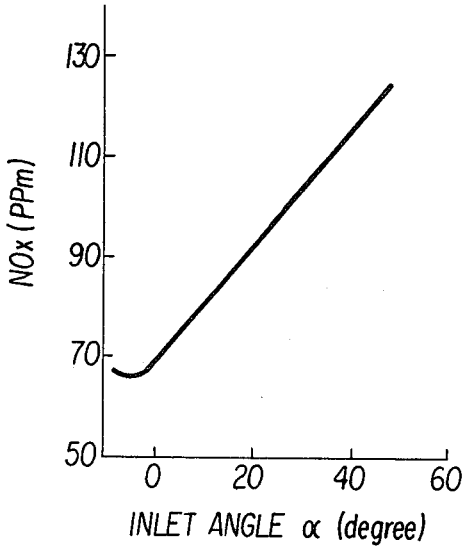
FIG. 9 is a graph showing how the inlet angle of the swirler affects the generation of NOx.

FIG. 9 is a graph showing the relationship between the NOx generation and the inlet angle $\alpha$ of the swirler. More specifically, this graph has been obtained by plotting the result of measurement of the NOx generation when the combustion is made with kerosene under the condition of ratio of diameter d/D of 0.71 and swirling angle $\beta$ of swirler of 30°, for various inlet angle $\alpha$. The amount of NOx is represented on the basis of 4% $O_2$. Also, the amounts of NOx mentioned hereinafter are represented on the basis of 4% $O_2$.

From FIG. 9, it will be apparent that the amount of NOx generated during the combustion is increased as the inlet angle $\alpha$ becomes greater. This can be attributed to the fact that the larger inlet angle $\alpha$ provides a larger radially inward component of the swirl velocity to promote the mixing of fuel with the air. Conventionally, the inlet angle $\alpha$ has been selected to be greater than 15°. From FIG. 9, however, it will be seen that rather small inlet angle $\alpha$ is effective in the reduction of generation of NOx. More particularly, this angle $\alpha$ is preferably not greater than 15° and more preferably between 0° and 5°.

Hereinafter, a practical example of the combustion method will be described by way of reference.

EXAMPLE 1

Figure 1:
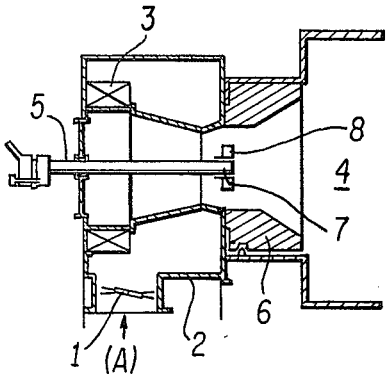
FIGS. 1 and 2 are sectional views of essential parts of conventional combustion systems having burners.

A combustion was conducted in a water-tube type package boiler having a combustion system as shown in FIG. 3 and an evaporation capacity of 8 t/h, using a heavy oil as the fuel. An axial-flow type swirler having a swirling angle of inclination of 36° was used. The flow velocity of the combustion air at the swirler outlet was set at about 18 m/s under the condition of stoichiometric ratio with rated load. The distance between the burner tip end and the inner axial end of the swirler was selected to be 50 mm. At the same time, a combustion was conducted in accordance with the conventional combustion method with the same type of boiler having a combustion system as shown in FIG. 1, by way of reference. In each case, an internal mixing steam atomizing type burner was used.

FIGS. 10 I and 10 II show the results of the combustion. More particularly, FIG. 10 shows the rate of reduction (%) of oxygen ($O_2$) in the flue, while FIG. 10 II shows the rate of reduction of NOx generation. These rates are calculated in relation to the $O_2$ concentration and the NOx generation as observed in the combustion carried out in accordance with the conventional combustion method. Namely, the rate of reduction of $O_2$ shows how the $O_2$ concentration is reduced in the combustion of the present invention as compared with that observed in the combustion of the conventional method at the same smoke density. The larger reduction of $O_2$ concentration means that the emission of unburnt substances such as smoke is reduced to permit a low oxygen combustion to improve the boiler efficiency. As will be seen from FIG. 10 II, the rate of reduction of NOx generation is as large as 25 to 50%. Also, FIG. 10 I shows that the $O_2$ concentration is reduced by 1.0 to 3.6%. As a result, the boiler efficiency under normal operating condition is improved by about 2%. Also, a stable combustion was maintained even in the low load operation.

EXAMPLE 2

A combustion was conducted with a flue smoke tube type boiler (evaporation capacity 3 t/h) having a combustion system incorporating a conical air register as shown in FIG. 4, using A heavy oil as the fuel. The swirl number S, mean flow velocity of combustion air and the distance between the burner tip end and the swirler were selected to be 0.51, 20 m/sec and 20 mm, respectively. At the same time, a combustion was conducted with the same boiler having the same evaporation capacity and a combustion system as shown in FIG. 2, in accordance with the conventional combustion method, by way of reference. In each case, a pressure atomizing type burner was used.

Figure 11:
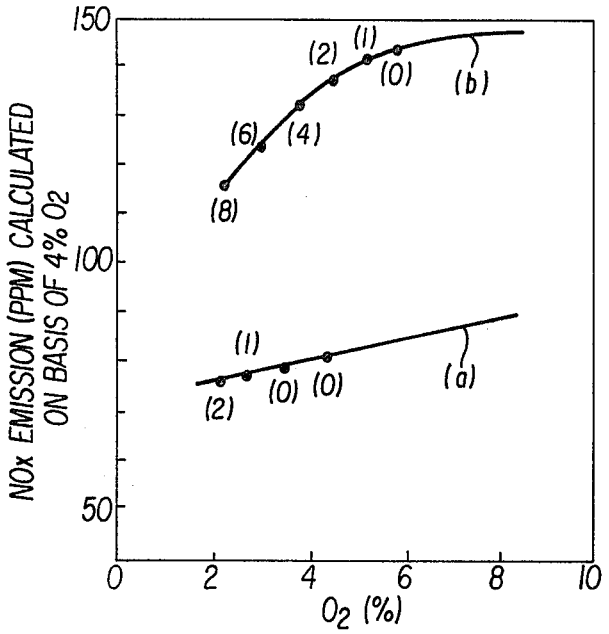
FIG. 11 is a graph showing the rate of generation of NOx by various $O_2$ concentrations.

FIG. 11 shows NOx emission (ppm) calculated on the basis of 4% $O_2$ as observed in each combustion. The curves a and b show the NOx generations as observed in the combustion of the invention and in the conventional combustion, respectively. The numerals attached to these curves show the smoke density (Bacharach smoke number). From FIG. 11, it will be seen that the smoke density in the combustion in accordance with the invention is greatly reduced as compared with that in the combustion in accordance with the conventional combustion method at the same air ratio ($O_2$%). Also, a reduction of NOx generation which is as large as about 45% is achieved by the combustion method of the invention.

From the foregoing description, it will be seen that, according to the invention, the generation of NOx is remarkably reduced by a simple combustion system or a simple modification of combustion system of already-constructed boilers. Also, the generation of smoke is largely decreased to permit the low oxygen combustion to contribute greatly to the improvement in the boiler efficiency.

Figure 12:
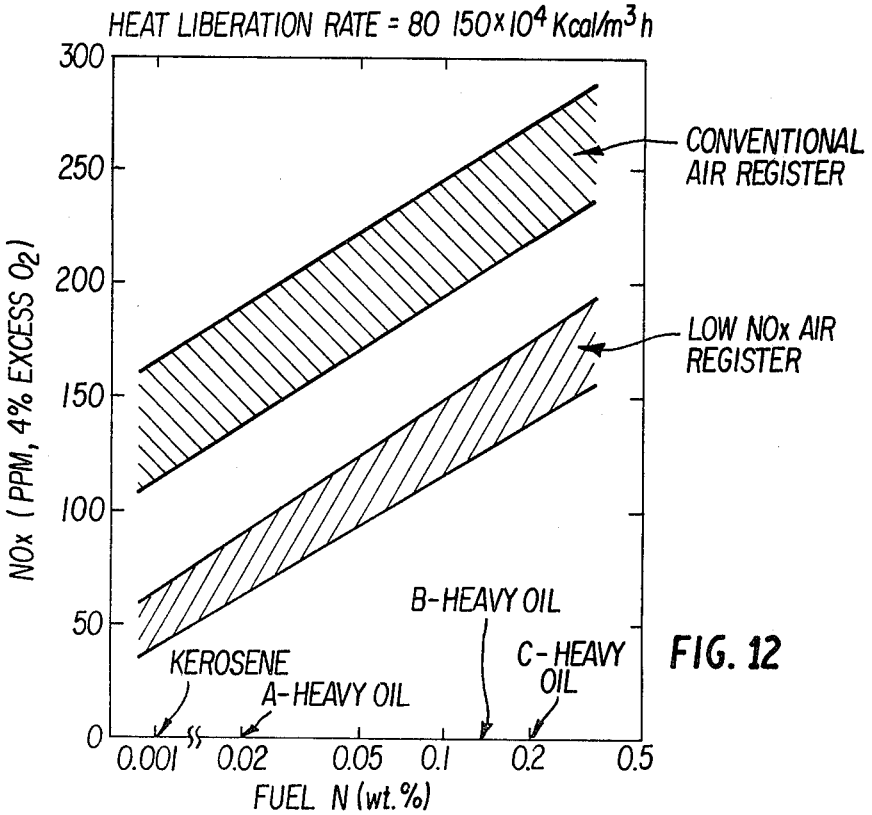
FIG. 12 shows how the generation of NOx is reduced by the use of the combustion method of the invention in comparison with the conventional combustion method.

According to the invention, as will be seen from FIG. 12, a superior combustion is effected as compared with the conventional combustion method, irrespective of the kind of fuel. Thus, the combustion method of the invention has a wide range of application.

Also, the unstable combustion in the low load operation, which was often observed in the conventional combustion method, is fairly avoided.

As has been described, the combustion method of the invention offers various industrial advantages.

What is claimed is:

1. A combustion method for reducing the emission of NOx and smoke in a boiler or furnace having a combustion chamber, a burner and a passage of combustion air around said burner, comprising:

injecting fuel from a fuel injector into a fuel rich zone of said combustion chamber and with a predetermined spread angle;

introducing combustion air with low velocity into said fuel rich zone; and utilizing a swirler located in said passage for combustion air at a distance of not greater than 200 mm from said fuel injector to swirl combustion air into a fuel lean zone surrounding said fuel rich zone, wherein said swirler is adjusted to provide the swirled air with a mean velocity between 10 m/sec and 30 m/sec, with a swirl number between 0.35 and 1.5 and with a spread angle greater than said spread angle of said fuel, wherein said fuel and said low velocity combustion air in said fuel rich zone are enveloped by said swirled air, whereby the rapid mixing of fuel and air in the initial stage of combustion is suppressed.

2. A combustion method as claimed in claim 1, wherein said low velocity combustion air is primary air passing through a diffuser and the combustion air passing through said swirler is secondary air, the ratio of amount of secondary air to the amount of the entire combustion air being not smaller than 65%, and wherein the position of injection of said fuel is adjusted.

3. A combustion method as claimed in claim 2, wherein a guide ring is disposed around the end portion of said diffuser.

4. A combustion method as claimed in claim 1, wherein the inlet angle $\alpha$ of said swirler is not greater than 15°.

5. A combustion method as claimed in claim 1 wherein at least one of the end of said burner and the end of the combustion air swirler is located in close proximity of the inner end of the combustion chamber.

6. A combustion method as claimed in claim 1, wherein the injection direction of fuel is at an angle of 5° to 45° to the air stream axis, and the mixing of fuel and air in the combustion zone is limited.

7. A combustion method as claimed in claim 1, wherein the swirl number of the combustion air falls within the range of between 0.4 an 1.0.

8. A combustion method as claimed in claim 1, wherein the mean velocity of flow of the combustion air falls within the range of between 13 and 23 m/s.

* * * * *